US006249092B1

(12) United States Patent
Kanatani

(10) Patent No.: US 6,249,092 B1
(45) Date of Patent: Jun. 19, 2001

(54) DIMMABLE LIGHTING APPARATUS USING A DISCHARGE LAMP

(75) Inventor: Hisao Kanatani, Tokyo (JP)

(73) Assignee: Coburn Japan Corporation, Tokyo (JP)

( * ) Notice: Subject to any disclaimer, the term of this patent is extended or adjusted under 35 U.S.C. 154(b) by 0 days.

(21) Appl. No.: 09/409,987

(22) Filed: Sep. 30, 1999

(30) Foreign Application Priority Data

Sep. 30, 1998 (JP) ..... 10-277494

(51) Int. Cl.[7] ..... F21P 3/00

(52) U.S. Cl. ..... 315/316; 315/292; 315/312; 362/85; 362/233; 362/284; 362/285

(58) Field of Search ..... 315/292, 294, 315/298, 312, 313, 316, 317, 318, 324; 362/233, 284, 285, 286, 293

(56) References Cited

U.S. PATENT DOCUMENTS 4,392,187 * 7/1983 Bornhorst ..... 362/286
5,502,627 * 3/1996 Hunt et al. ..... 362/286
5,758,955 * 6/1998 Belliveau ..... 362/293

FOREIGN PATENT DOCUMENTS 4-3092 6/1929 (JP) .
5542207 9/1953 (JP) .

* cited by examiner

*Primary Examiner*—Don Wong
*Assistant Examiner*—Wilson Lee
(74) *Attorney, Agent, or Firm*—Birch, Stewart, Kolasch & Birch, LLP

(57) ABSTRACT

A lighting apparatus capable of dimming lighting units using a discharge lamp in various ways. Each lighting unit includes a metal halide lamp and two spaced shutters arranged in front of the lamp on the optical path of the lamp. A shutter driver selectively opens or closes the shutters for mechanically dimming light issuing from the lamp. Six lighting units are cascaded in a single group. Ballast boxes each are assigned to a particular lighting unit and include a power supply section for feeding electric power to the lamp and a shutter controller for controlling a shutter driver. These structural elements are collectively controlled from a keyboard via a single control box. A command generating section included in the control box transforms a command input on the keyboard to a command for controlling the individual lighting unit. A selector also included in the control box distributes the command to five groups of lighting units. The apparatus allows the power supply and dimming of the individual lighting unit to be controlled via the keyboard.

9 Claims, 4 Drawing Sheets

DIMMABLE LIGHTING APPARATUS USING A DISCHARGE LAMP

BACKGROUND OF THE INVENTION

1. Field of the Invention

The present invention relates to a lighting apparatus and more particularly to a profile spotlight or similar lighting apparatus capable of controllably dimming a lighting unit using a discharge lamp.

2. Description of the Background Art

A theater, hall, window display or similar cite is, in many cases, lighted by lighting units using halogen lamps. Metal halide lamps have a higher emission efficiency than halogen lamps and can emit a great quantity of light with small power while radiating a minimum of heat. However, metal halide lamps, which are discharge lamps, are difficult to electrically dim and are not suitable for profile spotlights required to dim a plurality of lighting units in various ways at the same time.

SUMMARY OF THE INVENTION

It is therefore an object of the present invention to provide a lighting apparatus capable of dimming a plurality of lighting units using discharge lamps in various ways.

In accordance with the present invention, a lighting apparatus includes a housing accommodating a removable discharge lamp. A shutter mechanism is positioned on the optical path of the discharge lamp in front of the lamp for p physically or mechanically opening or closing the optical path to thereby dim light issuing from the lamp. A lens converges the light passed through the shutter mechanism. A casing accommodates the housing, shutter mechanism and lens. A power supply section feeds electric power to the discharge lamp. A controller is operative in response to a control signal to control the power supply section for setting up or interrupting electric power feed from the power supply section to the discharge lamp, and control the shutter mechanism for dimming the light.

Also, in accordance with the present invention, a lighting apparatus includes a housing accommodating a removable discharge lamp. A first shutter mechanism is positioned on the optical path of the discharge lamp in front of the lamp for physically or mechanically opening or closing the optical path to thereby dim light issuing from the lamp. A lens converges the light passed through the first shutter mechanism. A second shutter mechanism is positioned on the optical path for physically or mechanically opening or closing an optical path on which the light converged by the lens is propagated to thereby dim the light. A casing accommodates the housing, first shutter mechanism, second shutter mechanism and lens. A power supply section feeds electric power to the discharge lamp. A controller is operative in response to a control signal to control the power supply section for setting up or interrupting electric power feed from the power supply section to the discharge lamp, and control at least one the first and second shutter mechanisms to thereby dim the light.

BRIEF DESCRIPTION OF THE DRAWINGS

The objects and features of the present invention will become more apparent from the consideration of the following detailed description taken in conjunction with the accompanying drawings in which.

DESCRIPTION OF THE PREFERRED EMBODIMENTS

Figure 1:
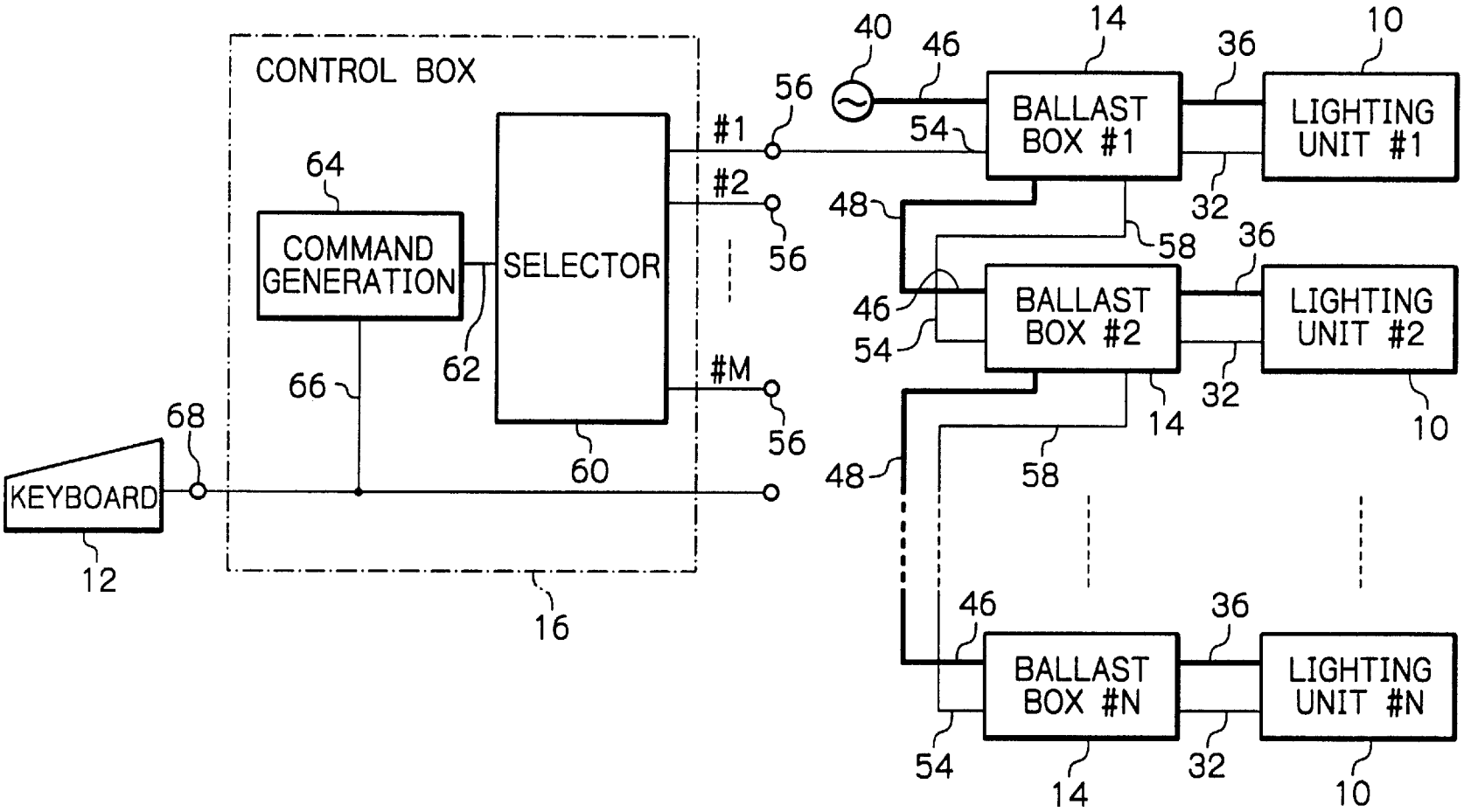
FIG. 1 is a schematic block diagram showing a lighting apparatus embodying the present invention.

Referring to FIG. 1 of the drawings, a lighting apparatus embodying the present invention is implemented as a profile spotlight system by way of example. As shown, the lighting apparatus includes N lighting units 10 (#1 through #N) and a keyboard 12. It is to be noted that N is a natural number and may be "6" by way of example. The operator of the lighting apparatus is capable of controllably dimming the lighting units 10 via the keyboard 12. The lighting units 10 can therefore play the role of high illumination, ellipsoidal spotlights.

Specifically, N ballast boxes 14 (#1 through #N) are respectively connected to the N lighting units 10. A single control box 16 is connected to the N ballast boxes 14 for controlling them collectively.

Figure 2:
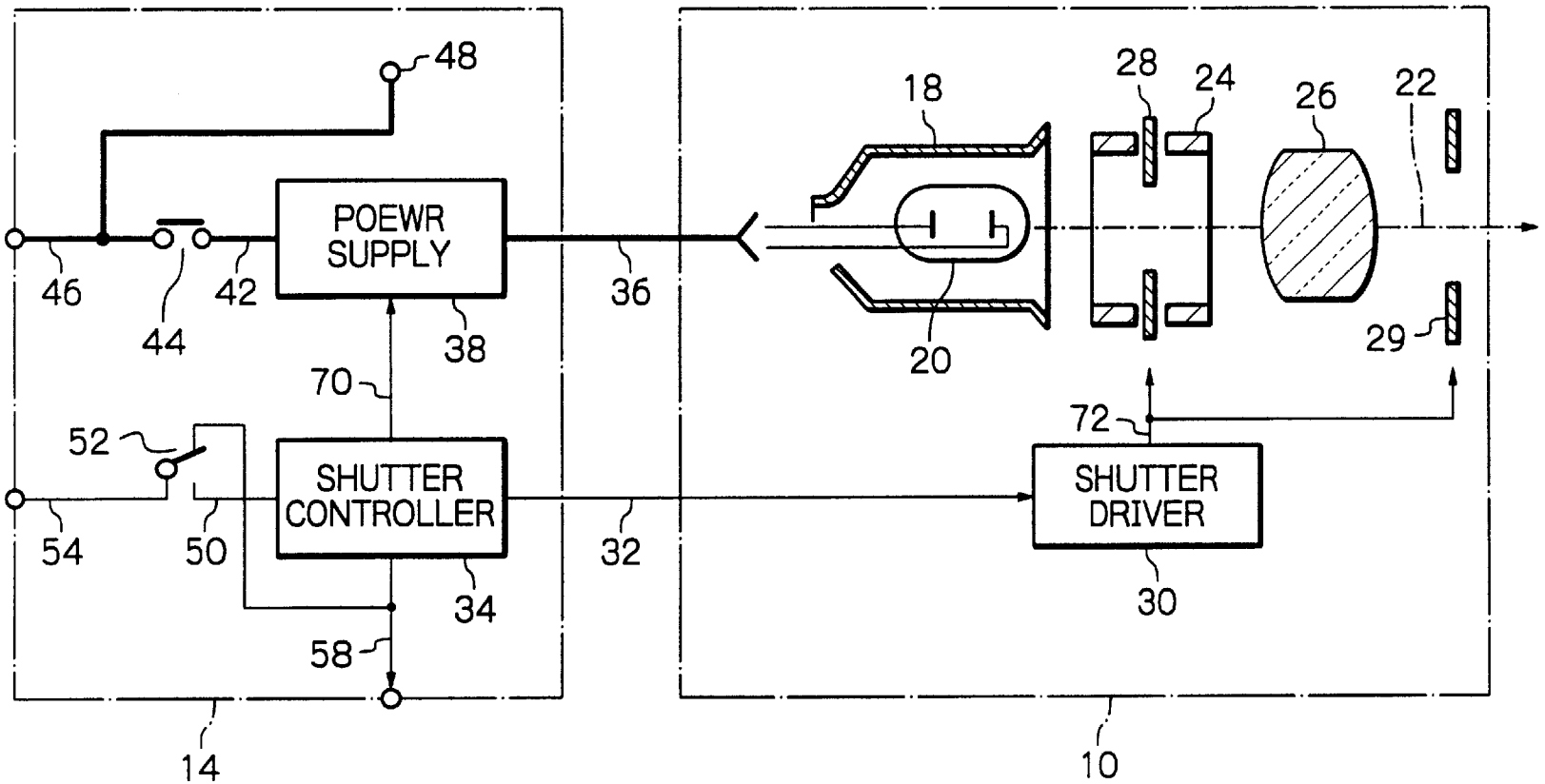
FIG. 2 is a schematic block diagram showing a specific configuration of a lighting unit and a ballast box included in the illustrative embodiment.

As shown in FIG. 2, each lighting unit 10 includes a reflector housing 18 and discharge lamp 20 removably accommodated in the housing 18. The discharge lamp 20 should preferably be implemented by a high illumination, metal halide lamp. A rotatable barrel 24 and a lens tube 26 are arranged on the optical axis 22 of the discharge lamp 20, as illustrated. The lens tube 26, preferably including a convex lens and a plano-convex lens, is capable of converging light issuing from the discharge lamp 20 to a desired object to be lighted. The lighting unit 10 with such a configuration can be implemented if, e.g., a commercially available device Source-Four (trade name) is modified for use with a halogen lamp.

The barrel 24 is rotatable about the optical axis 22 while supporting a replaceable negative for a slide. In the illustrative embodiment, the barrel 24 should preferably support, e.g., a movable iris shutter 28 for following operation in its iris slot. Intervening between the lamp or light source 20 and the lens tube or converging lens 26, the iris shutter 28 allows the light 22 to form a spot having a desired diameter and a sharp edge on a desired object. A douser shutter 29 for dimming, for example, is positioned on the optical axis 22 of the lens tube 26 in front of the lens tube 26 in addition to or in place of the iris shutter 28. The douser shutter 29 should preferably be of the type having a pair of bladed plates, not shown, each being formed with sixteen slits in the form of saw-teeth. The bladed plates face each other on opposite sides of the optical path 22. A drive motor, not shown, causes the bladed plates to move toward or away from each other for adjusting the size of the optical path 22, i.e., the brightness of the light 22. If desired, the two bladed plates may be replaced with four to sixteen bladed or slit plates, not shown, and arranged around the optical path to be movable toward and away from each other.

A shutter driver 30 controls the above movement of the shutters 28 and 29. The shutter driver 30 includes a motor or a solenoid, not shown, for driving the shutters 28 and 29, as schematically represented by arrows 72. The ballast box 14 assigned to the lighting unit 10 includes a shutter controller 34 connected to the shutter driver 30 by a drive line 32. The ballast box 14 additionally includes a power supply 38 connected to the discharge lamp 20 by a power supply line 36. In the illustrative embodiment, the lighting unit 10 and associated ballast box 14 each are accommodated in a respective casing, as represented by a dotted line in FIG. 2. The drive line 32 and power supply line 36 are removably connected to the lighting unit 10 and ballast box 14 via connectors not shown. Alternatively, the lighting unit 10 and ballast box 14 may be accommodated together in a single casing.

The power supply 38 included in the ballast box 14 includes a ballast and a no-fuse breaker, not shown, and plays the role of a power supply circuit for receiving electric power from, e.g., a commercially available 100 V power supply 40, see FIG. 1. For this purpose, the power supply 38 has its input side 42 connected to a feed line 46 via a power supply switch 44. The feed line 46 is connected to the commercial electricity power supply 40. The feed line 46 is connected to the other or output feed line 48 also. This feed line 48 is removably cascaded to the corresponding input feed line 46 of another ballast box 14, as shown in FIG. 1.

In the ballast box 14, the shutter controller 34 has its input 50 connected to a control line 54 via a mode switch 52. The control line 54 is connected to a control output 56 included in the control box 16, see FIG. 1. The mode switch 52 is a selector for allowing the operator to select either a local operation mode for operating the ballast box 14 within the operator's reach or a remote operation mode for operating it by remote control, as desired. The mode switch 52 sets up the local operation mode in the position shown in FIG. 2 or sets up the remote operation mode in the position opposite thereto. The input 50 of the shutter controller 34 should preferably have the USITT (United States Institute for Theatre Technology, Inc.) Standard, DMX-512 protocol and can be connected to, e.g., a general-purpose personal computer via an interface RS-412.

The shutter controller 34 has another control output 70 connected to the power supply 38. The shutter controller 34 decodes a command, which will be described later, applied to its input 50 and decodes it. In accordance with the decoded command, the shutter controller 34 controls the electric power feed from the power supply 38 to the lamp 20 via the control line 70 in order to turn on, turn off or blink the lamp 20, as desired. At the same time, the shutter controller 34 controls the motor and/or the solenoid of the shutter driver 30 for causing the shutters 28 and 29 to open or close. The shutter controller 34 additionally has an output control line 58 removably cascaded to the corresponding input control line 54 of another ballast box 14, as shown in FIG. 1.

Referring again to FIG. 1, the control box 16 has M output control lines 56, M being a natural number. Therefore, in the illustrative embodiment, the control box 16 is capable of accommodating M groups of N pairs of lighting units 10 and ballast boxes 14. It follows that the lighting apparatus allows N×M lighting units 10 at maximum to be arranged in, e.g., a theater, hall, window display or similar cite and collectively controlled via the keyboard 12 as to blinking and lightness/darkness. In the illustrative embodiment, there are provided a first group including control channels #1 through #6, a second group including control channels #7 through #12, and so forth; a fifth group includes channels #25 through #30.

The control box 16 includes a selector 60 having M outputs #1 through #M each being connected to particular one of the output control lines 56. The selector 60 transfers a signal applied to its input 62 to one of the M output control lines 56 in accordance with the signal. The input 62 is connected to a command generation 64 having an input 66 thereof connected to the output 68 of the keyboard 12. In response to a signal output from the keyboard 12, the command generation 64 generates a command based on the DMX-512 protocol for controlling the individual lighting unit 10. The control box 16 may advantageously be implemented by a microcomputer or similar processing system. In the illustrative embodiment, the control box 16 is accommodated in a casing independent of the keyboard 12 and ballast boxes 14.

The keyboard 12 includes keys, not shown, to be operated by the operator of the lighting apparatus. When the operator operates any one of the keys, the keyboard 12 sends a corresponding signal to the control box 16 via the output 68. The keys include selector switches for designating any one of the lighting units 10 and dim switches for turning on or dimming the designated lighting unit 10 and adjusting the blinking interval of the lighting unit 10. The keyboard 12 may additionally include a display for displaying the conditions of the control box 16.

In operation, the operator first turns on the power supply switches 44 of the ballast boxes 14 assigned to the lighting units 10 to be collectively controlled. In addition, the operator conditions the mode switch 52 for the remote operation mode. Subsequently, the operator inputs on the keyboard 12 a number, or channel, assigned to any one of the lighting units 10 to turn on, turn off, blink or control illumination. At the same time, the operator inputs whether to turn on the designated lighting unit 10 or to turn it off, a blinking interval, and illumination. Signals representative of such designated conditions are sent from the keyboard 12 to the command generation 64 via the line 68 and a line 66. The command generation 64 transforms the input signals to a signal representative of the lighting unit 10 to be controlled and a command representative of the control conditions. The command is fed from the command generation 64 to the selector 60 via the output 62. The selector 60 transfers the input command to the output 56 assigned to the group including the subject lighting unit 10 in accordance with the DMX-512 protocol.

The command output from the command generation 64 is sequentially transferred to the N cascaded ballast boxes 14. In each ballast box 14, the shutter controller 34 determines whether or not the above command includes a command meant for the lighting unit 10 associated with the ballast box 14. If such a command is present, then the shutter controller 34 takes it in and decodes it. The shutter controller 34 controls, based on the decoded command, power feed from the power supply 38 to the lamp 20 via the control line 70 for thereby turning on or off the lamp 20, or blinking it at desired intervals. In addition, the shutter controller 34 controls the motor and/or the solenoid of the shutter driver 30 in order to open or close each of the shutters 28 and 29 to a desired degree, thereby providing the light 22 with desired illumination. In this manner, the operator is capable of dimming each of the M groups of N lighting units 10 independently of the others via the keyboard 12.

Figure 3:
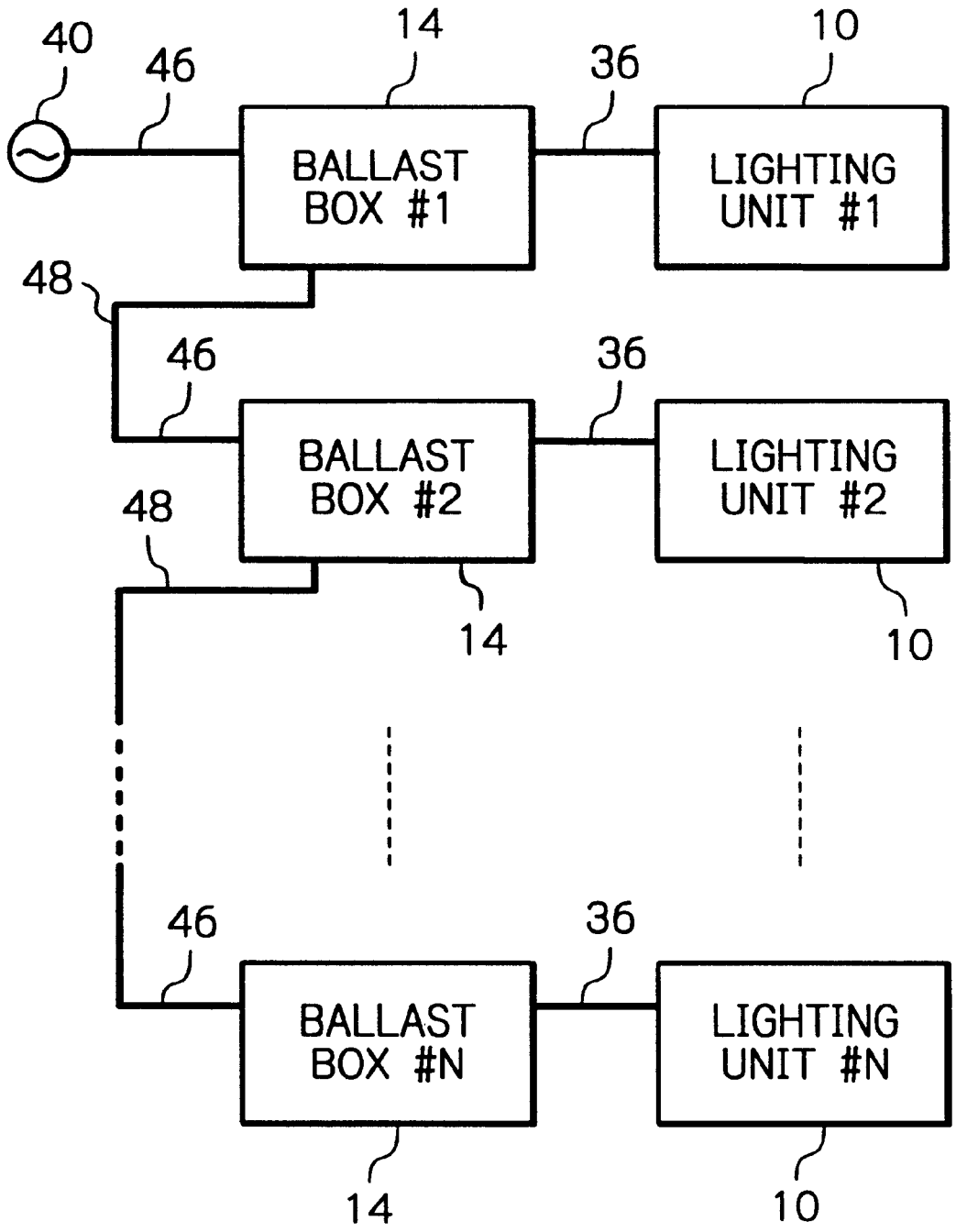
FIG. 3 is a schematic block diagram showing an alternative embodiment of the present invention.
Figure 4:
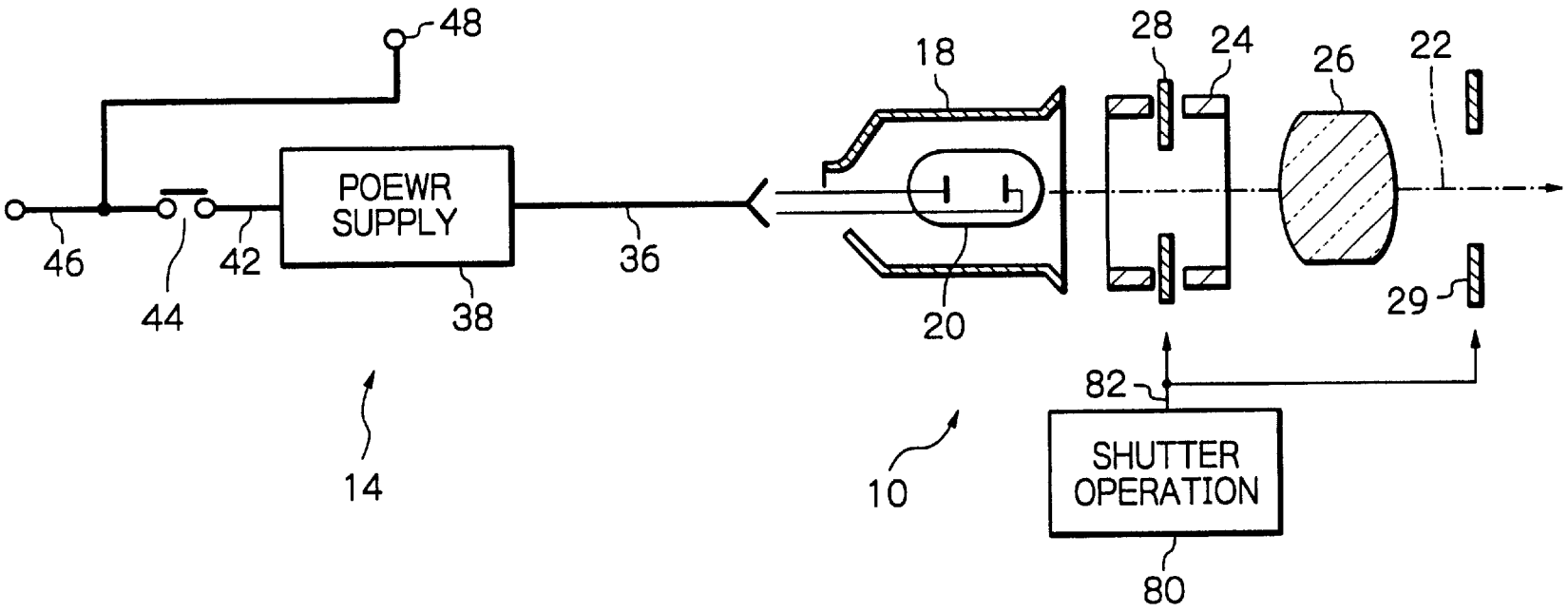
FIG. 4 is a schematic block diagram showing a specific configuration of a lighting unit and a ballast box included in the alternative embodiment.

Referring now to FIGS. 3 and 4, an alternative embodiment of the lighting apparatus in accordance with the present invention is identical with the previous embodiments except for the following. As shown, the illustrative embodiment does not include the keyboard 12 or the control box 16. Each ballast box 14 does not include the shutter controller 34. Each lighting unit 10 includes a shutter operation 80 in place of the shutter driver 30. With this configuration, the illustrative embodiment allows the operator to manually turn on or off, or blink the individual lighting unit 10 via the associated ballast box 14. In FIGS. 3 and 4, structural elements like the structural elements of FIGS. 1 and 2 are designated by identical reference numerals and will not be described specifically in order to avoid redundancy.

As shown in FIG. 4, the operator is capable of turning on or turning off the power supply 38 of each ballast box 14 by operating the power supply switch 44 by hand. The shutters 28 and 29 of each lighting unit 10 may each be configured in the same manner as in FIG. 2. In this embodiment, the shutters 28 and 29 are not electrically driven via the shutter driver 30, but are operated by hand via the shutter operation 80, as schematically represented by arrows 82. Either the shutter 28 or the shutter 29 may be omitted, if desired.

In operation, the operator manually turns on the power supply switch 44 of the ballast box 14 assigned to the lighting unit 10 to be controlled and turns on, turns off or blinks the lighting unit 10. In addition, the operator positions the mode switch 52, FIG. 2, of the above ballast box 14 for the local operation mode (handy fader side). In this condition, the operator is capable of opening or closing the shutters 28 and 29 to a desired degree via the shutter operation 80 for a dimming purpose.

In summary, it will be seen that the present invention provides a lighting apparatus capable of allowing an operator to controllably dim a plurality of lighting units each including a discharge lamp in various ways. This unprecedented advantage is derived from the combination of a douser shutter, iris shutter or similar mechanical dimming device and a metal halide lamp or similar discharge lamp.

The entire disclosure of Japanese patent application No. 277494/1998 filed on Sep. 30, 1998 and including the specification, claims, accompanying drawings and abstract of the disclosure is incorporated herein by reference in its entirety.

While the present invention has been described with reference to the illustrative embodiments, it is not to be restricted by the embodiments. It is to be appreciated that those skilled in the art can change or modify the embodiments without departing from the scope and spirit of the present invention.

What is claimed is:

1. A lighting apparatus comprising:

a housing accommodating a removable discharge lamp;

a first shutter mechanism positioned on an optical path of said discharge lamp in front of said discharge lamp for mechanically opening or closing said optical path to thereby adjust a size of the optical path of light issuing from said discharge lamp;

a lens for converging the light passed through said first shutter mechanism;

a second shutter mechanism positioned on said optical path for physically opening or closing an optical path on which the light converged by said lens is propagated to thereby dim said light;

a casing accommodating said housing, said first shutter mechanism, said second shutter mechanism and said lens;

a power supply section for feeding power to said discharge lamp; and a control means operative in response to a control signal for controlling said power supply section to thereby set up or interrupt power feed from said power supply section to said discharge lamp, and controlling at least one said first shutter mechanism and said second shutter mechanism to thereby dim the light.

2. The lighting apparatus in accordance with claim 1, wherein said discharge lamp comprises a metal halide lamp.

3. The lighting apparatus in accordance with claim 2, wherein said first shutter mechanism and said second shutter mechanism include an iris shutter and a douser shutter, respectively.

4. The lighting apparatus in accordance with claim 1, further comprising:

a power supply switch for selectively setting up or interrupting the power feed to said power supply section; and a mode switch for selecting either one of a remote operation mode responsive to the control signal and a local operation mode not responsive to the control signal.

5. A lighting system comprising:

a plurality of lighting devices capable of being cascaded to each other;

a first control means connected to at least one of said plurality of lighting devices for controlling said plurality of lighting devices; and a manual input means connected to said first control means for sending a manually input command to said first control means;

each of said plurality of lighting devices comprising:

a housing accommodating a removable discharge lamp;

a first shutter mechanism positioned on an optical path of said discharge lamp in front of said discharge lamp for physically opening or closing said optical path to thereby adjust a size of the optical path of light issuing from said discharge lamp;

a lens for converging the light passed through said first shutter mechanism;

a second shutter mechanism positioned on the optical path of said discharge lamp for physically opening or closing an optical path on which light converged by said lens is propagated;

a first casing accommodating said housing, said first shutter mechanism, said second shutter mechanism and said lens;

a power supply section for feeding power to said discharge lamp;

a second control means operative in response to a control signal for controlling said power supply section to thereby turn on or turn off power feed from said power supply section to said discharge lamp, and controlling at least one of said first shutter mechanism and said second shutter mechanism to thereby dim the light; and a second casing accommodating said power supply section and said second control means:

said power supply section and said second control means being respectively cascaded to a corresponding power supply section and a corresponding second control means throughout second casings of said plurality of lighting devices;

said first control means generating, in response to the command, a control signal meant for a designated one of said plurality of lighting devices, whereby said second control means of the designated lighting device controls dimming in accordance with said control signal.

6. The lighting system in accordance with claim 5, wherein said power supply section of each of said plurality of lighting devices is connected to a shared power supply, said second control means of each of said plurality of lighting devices being cascaded to a second control means of another one of said plurality of lighting devices.

7. The lighting apparatus in accordance with claim 5, wherein said discharge lamp comprises a metal halide lamp.

8. A lighting apparatus in accordance with claim 1, wherein said power supply is 100 V power supply.

9. Lighting systems in accordance with claim 5, wherein said power supply is a 100 V power supply.

* * * * *